US010619123B2

(12) United States Patent
Somerville Roberts et al.

(10) Patent No.: US 10,619,123 B2
(45) Date of Patent: Apr. 14, 2020

(54) METHOD FOR REDUCING GELLING BETWEEN A LIQUID LAUNDRY DETERGENT AND A LIQUID FABRIC ENHANCER

(71) Applicant: The Procter & Gamble Company, Cincinnati, OH (US)

(72) Inventors: Nigel Patrick Somerville Roberts, Newcastle-upon-Tyne (GB); Ming Tang, Beijing (CN); Gayle Marie Frankenbach, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 16/106,683

(22) Filed: Aug. 21, 2018

(65) Prior Publication Data

US 2019/0055495 A1 Feb. 21, 2019

Related U.S. Application Data

(63) Continuation of application No. PCT/CN2017/097817, filed on Aug. 17, 2017.

(51) Int. Cl.

| | |
|---|---|
| ***C11D 3/00*** | (2006.01) |
| ***C11D 1/83*** | (2006.01) |
| ***C11D 17/04*** | (2006.01) |
| ***C11D 3/43*** | (2006.01) |
| ***C11D 1/831*** | (2006.01) |
| ***C11D 3/30*** | (2006.01) |
| ***C11D 11/00*** | (2006.01) |
| ***D06F 39/08*** | (2006.01) |
| *C11D 3/20* | (2006.01) |
| *C11D 1/14* | (2006.01) |
| *C11D 1/72* | (2006.01) |
| *D06F 39/02* | (2006.01) |

(52) U.S. Cl.

CPC ..... *C11D 3/0015* (2013.01); *C11D 1/83* (2013.01); *C11D 1/831* (2013.01); *C11D 3/30* (2013.01); *C11D 3/43* (2013.01); *C11D 11/0017* (2013.01); *C11D 17/04* (2013.01); *D06F 39/088* (2013.01); *C11D 1/143* (2013.01); *C11D 1/72* (2013.01); *C11D 3/2006* (2013.01); *C11D 3/2041* (2013.01); *C11D 3/2065* (2013.01); *C11D 3/2068* (2013.01); *D06F 39/022* (2013.01)

(58) Field of Classification Search

CPC ..... C11D 3/0015; C11D 3/001; C11D 3/3773; C11D 11/0017; C11D 3/43; C11D 3/1266; C11D 1/04; C11D 1/29; C11D 1/83; C11D 1/66; C11D 1/44; C11D 1/94; C11D 17/045; C11D 1/8355; C11D 7/5004; C11D 10/045; C11D 17/0008; C11D 1/00

See application file for complete search history.

(56) References Cited

U.S. PATENT DOCUMENTS

| | | | | |
|---|---|---|---|---|
| 5,290,475 | A * | 3/1994 | Wixon | C11D 3/3715 510/299 |
| 7,018,966 | B2 | 3/2006 | Stoessel et al. | |
| 7,531,493 | B2 | 5/2009 | Schroeder et al. | |
| 2003/0116177 | A1 | 6/2003 | Appel et al. | |
| 2004/0033924 | A1 | 2/2004 | Murphy et al. | |
| 2007/0012344 | A1 | 1/2007 | Watts | |
| 2009/0095027 | A1 | 4/2009 | Deppermann et al. | |
| 2011/0005004 | A1* | 1/2011 | Dykstra | C11D 3/392 8/137 |

FOREIGN PATENT DOCUMENTS

| | | | |
|---|---|---|---|
| CN | 105199863 | | 12/2015 |
| GB | 2311767 | A | 10/1997 |
| WO | WO8601017 | A1 | 2/1986 |
| WO | WO2011029766 | A1 | 3/2011 |

OTHER PUBLICATIONS

AA1250 Search Report for PCT/CN2017/097817, dated Aug. 17, 2017, 4 pages.

* cited by examiner

*Primary Examiner* — Eisa B Elhilo

(74) *Attorney, Agent, or Firm* — Gregory S. Darley-Emerson

(57) ABSTRACT

A method is provided for reducing undesired gelling between a liquid laundry detergent and a liquid fabric enhancer inside an automatic laundry washing machine, by employing, in combination, liquid laundry detergent and liquid fabric enhancer of specific compositional characteristics. Laundry cleaning system and fabric cleaning kit that promote the combined use of such liquid laundry detergent and such liquid fabric enhancer.

20 Claims, No Drawings

METHOD FOR REDUCING GELLING BETWEEN A LIQUID LAUNDRY DETERGENT AND A LIQUID FABRIC ENHANCER

FIELD OF THE INVENTION

The present disclosure relates to a method for reducing gelling between a liquid laundry detergent and a liquid fabric enhancer, preferably inside an automatic laundry washing machine.

BACKGROUND OF THE INVENTION

It is known to clean a fabric article, such as clothing, by laundering it with a laundry detergent, and then to soften or condition it by applying a fabric softening or conditioning composition. The fabric softening or conditioning composition (hereinafter "fabric enhancer") typically contains a cationic softening or conditioning agent, which may interact with the anionic surfactants typically contained in the laundry detergent compositions to form flocculation or "scum" that will adversely affect both the cleaning and softening/conditioning performances of both products. Therefore, the conventional fabric enhancer is added in the rinse cycle of the laundering process, after the wash cycle has already been completed and most of the laundry detergent has already been drained off with the washing liquor.

The trend for washing is to use an automatic laundry washing machine wherein a laundry detergent and a fabric enhancer are dispensed from the washing machine via two separate compartments, thereby ensuring the automated release of the laundry detergent at the beginning of the washing cycle and of the fabric enhancer during the subsequent rinse cycle, usually near the end of the rinse cycle, or where multiple rinses are selected, during the final rinse process. This way, direct contact between the laundry detergent and the fabric enhancer is minimized during the laundering process.

However, such separate dispensing compartments still cannot completely prevent undesired contact between the laundry detergent and the fabric enhancer. For example, they may have dispensing outlets that are placed too close to each other, or even open into a common liquid pipeline. Residues of the laundry detergent and the fabric enhancer may be left near such dispensing outlets and/or inside the common liquid pipeline, thereby coming into contact with each other. Significant gelling has been observed between the laundry detergent in its undiluted form (i.e., before it is diluted by water) and the fabric enhancer in its undiluted form. Particularly, the undiluted laundry detergent and the undiluted fabric enhancer, when mixed together in an approximately 1:1 ratio, may form a highly viscous, gel-like composition. Such gel-like composition may either block the dispensing outlets or pipelines in the automatic laundry washing machines, or leave visible residue on fabrics due to its high viscosity.

Therefore, there is a continuing need for an easy and cost-effective method to mitigate or eliminate the above-mentioned gelling issue.

SUMMARY OF THE INVENTION

The present disclosure proposes to mitigate or eliminate the above-mentioned gelling issue in the automatic laundry washing machine, by providing a liquid laundry detergent and a liquid fabric enhancer of specific compositional characteristics, which, when mixed together in their respective undiluted forms at an approximately 1:1 weight ratio, exhibit a significantly reduced tendency of gelling than what has been typically observed between conventional liquid laundry detergents and liquid fabric enhancers.

The present disclosure relates to a method of reducing gelling between a liquid laundry detergent and a liquid fabric enhancer inside an automatic laundry washing machine, comprising the steps of:

a. providing a liquid laundry detergent that is characterized by: (i) a water content of no more than about 15 wt %; (ii) a nonionic surfactant content ranging from about 3 wt % to about 50 wt %; and (iii) an anionic surfactant content ranging from about 10 wt % to about 50 wt %, by total weight of said liquid laundry detergent;

b. providing a liquid fabric enhancer that comprises from about 2 wt % to about 90 wt % of a fabric softening agent, by total weight of said liquid fabric enhancer, wherein such liquid laundry detergent and such liquid fabric enhancer, when combined at an about 1:1 weight ratio, are characterized by: (i) a total surfactant content of greater than about 25 wt %; and (ii) a total organic solvent content of greater than about 7.5 wt %, by total weight of said liquid laundry detergent and said liquid fabric enhancer combined;

c. providing an automatic laundry washing machine that is configured so that at least an undiluted portion of the liquid laundry detergent comes into contact with at least an undiluted portion of the liquid fabric enhancer in the automatic laundry washing machine; and d. using the liquid laundry detergent and the liquid fabric enhancer inside said automatic laundry washing machine to treat fabrics.

The present disclosure also relates to a laundry cleaning system that includes an automatic laundry washing machine with a cleaning chamber, a water supply, a detergent dispenser, a fabric enhancer dispenser, while such detergent dispenser contains a liquid laundry detergent, while such fabric enhancer dispenser contains a liquid fabric enhancer, and while such detergent dispenser and such fabric enhancer dispenser are arranged so that at least an undiluted portion of the liquid laundry detergent comes into contact with at least an undiluted portion of the liquid fabric enhancer in the automatic laundry washing machine; while the liquid laundry detergent is characterized by: (i) a water content of no more than about 15 wt %; (ii) a nonionic surfactant content ranging from about 3 wt % to about 50 wt %; and (iii) an anionic surfactant content ranging from about 10 wt % to about 50 wt %, by total weight of the liquid laundry detergent; while the liquid fabric enhancer contains from about 2 wt % to about 90 wt % of a fabric softening agent, by total weight of the liquid fabric enhancer; and while the liquid laundry detergent and the liquid fabric enhancer, when combined at an about 1:1 weight ratio, are characterized by: (i) a total surfactant content of greater than about 25 wt %; and (ii) a total organic solvent content of greater than about 7.5 wt %, by total weight of the liquid laundry detergent and the liquid fabric enhancer combined.

The present disclosure also relates to a fabric cleaning kit comprising:

a. a first primary package containing a liquid laundry detergent;

b. a second, separate primary package containing a liquid fabric enhancer; and c. a secondary package containing said first primary package and said second primary package;

while such liquid laundry detergent is characterized by: (i) a water content of no more than about 15 wt %; (ii) a nonionic surfactant content ranging from about 3 wt % to about 50 wt %; and (iii) an anionic surfactant content ranging from about 10 wt % to about 50 wt %, by total weight of said liquid laundry detergent; while such liquid fabric enhancer contains from about 2 wt % to about 90 wt % of a fabric softening agent, by total weight of said liquid fabric enhancer; and while the liquid laundry detergent and the liquid fabric enhancer, when combined at an about 1:1 weight ratio, are characterized by: (i) a total surfactant content of greater than about 25 wt %; and (ii) a total organic solvent content of greater than about 7.5 wt %, by total weight of the liquid laundry detergent and the liquid fabric enhancer combined.

These and other aspects of the present disclosure will become more apparent upon reading the following detailed description.

DETAILED DESCRIPTION OF THE INVENTION

It has been discovered that by selectively using a liquid laundry detergent of specific compositional characteristics in combination with a liquid fabric enhancer of specific compositional characteristics, the above-mentioned undesirable gelling effect can be significantly reduced or eliminated. Specifically, the liquid laundry detergent is characterized by: (i) a water content of no more than about 15 wt %; (ii) a nonionic surfactant content ranging from about 3 wt % to about 50 wt %; and (iii) an anionic surfactant content ranging from about 10 wt % to about 50 wt %, by total weight of such liquid laundry detergent; the liquid fabric enhancer contains from about 2 wt % to about 90 wt % of a fabric softening agent, by total weight of such liquid fabric enhancer; more importantly, the liquid laundry detergent and the liquid fabric enhancer, when combined at an about 1:1 weight ratio, are characterized by: (i) a total surfactant content of greater than about 25 wt %; and (ii) a total organic solvent content of greater than about 7.5 wt %, by total weight of such liquid laundry detergent and such liquid fabric enhancer combined.

The above-described liquid laundry detergent and liquid fabric enhancer, when mixed together or otherwise combined (especially inside an automatic laundry washing machine), exhibit a significantly reduced tendency to form a gel, in comparison with conventional liquid laundry detergents and liquid fabric enhancers. The present invention therefore proposes a method of using the above-described liquid laundry detergent and liquid fabric enhancer together in side an automatic laundry washing machine to treat fabrics. The present invention also proposes a laundry cleaning system containing an automatic laundry washing machine so configured that at least an undiluted portion of the liquid laundry detergent comes into contact with at least an undiluted portion of the liquid fabric enhancer in such automatic laundry washing machine. The present invention further proposes a fabric cleaning kit containing such liquid laundry detergent and such liquid fabric enhancer for joint commercialization.

As used herein, articles such as "a" and "an" when used in a claim, are understood to mean one or more of what is claimed or described. The terms "comprise," "comprises," "comprising," "contain," "contains," "containing," "include," "includes" and "including" are all meant to be non-limiting.

As used herein, the terms "substantially free of" or "substantially free from" mean that the indicated material is at the very minimum not deliberately added to the composition to form part of it, or, preferably, is not present at analytically detectable levels. It is meant to include compositions whereby the indicated material is present only as an impurity in one of the other materials deliberately included.

As used herein, the term "liquid" refers to a fluid having a liquid having a viscosity of from about 1 to about 2500 mPa·s at 20° C. and a shear rate of 20 $sec^{-1}$. In some embodiments, the viscosity of the liquid may be in the range of from about 100 to about 2000 mPa·s at about 20° C. at a shear rate of about 20 $sec^{-1}$. In some embodiments, the viscosity of the liquid may be in the range of from about 200 to about 1500 mPa·s at about 20° C. at a shear rate of about 20 $sec^{-1}$. The viscosity can be determined using a Brookfield viscometer, No. 2 spindle, at 60 RPM/s.

The term "gelling" as used herein refers to a gel-forming phenomenon exhibited by two or more liquids when they are mixed at an about 1:1 weight ratio, which results in a significant increase in the liquid viscosity. Specifically, viscosity of the resulting mixture is at least about 50%, preferably at least about 80%, more preferably at least about 100%, and most preferably at least about 150%, higher than that of the more viscous liquid (if only two liquids are mixed) or the most viscous liquid (if more than two liquids are mixed) before mixing, while the viscosity is measured at about 20° C. and at a shear rate of about 1 $sec^{-1}$. For example, when a liquid A having a relatively low viscosity of about 500 mPa·s is mixed with a liquid B having a relatively high viscosity of about 1000 mPa·s, then gelling is deemed to have happened if the mixture of these two liquids has a viscosity that is about 1500 mPa·s or more, when measured at about 20° C. and at a shear rate of about 1 $sec^{-1}$. In contrast, if the mixture of these two liquids has a viscosity that is lower than, or the same as, or only slightly higher than about 1000 mPa·s, then no gelling has happened.

As used herein, the term "soiled material" is used non-specifically and may refer to any type of flexible material consisting of a network of natural or artificial fibers, including natural, artificial, and synthetic fibers, such as, but not limited to, cotton, linen, wool, polyester, nylon, silk, acrylic, and the like, as well as various blends and combinations. Soiled material may further refer to any type of hard surface, including natural, artificial, or synthetic surfaces, such as, but not limited to, tile, granite, grout, glass, composite, vinyl, hardwood, metal, cooking surfaces, plastic, and the like, as well as blends and combinations.

As used herein, the term "primary package" refers to a product package that is in direct contact with the product in issue, e.g., the liquid laundry detergent product or the liquid fabric enhancer product. Such primary package can be selected from the group consisting of pouches (especially standup pouches), bottles, jars, cans, cartons, and the like. Such primary package is preferably water-proof or water-resistant, and can be transparent, translucent, or opaque.

As used herein, the term "secondary package" refers to a product package that is not in direct contact with the product(s) in issue, but is placed outside of one or more primary package(s), either to protect or beautify the primary package(s), or to enclose two or more primary packages to form one unitary item for retail purposes. Such secondary package is designed for on-shelf display or in-store commercialization of the product(s) in issue, and it is therefore distinguished from the shipping or storage package, which is typically removed before the on-shelf display or in-store commercialization of the product(s) in issue. Such secondary package preferably has an exterior surface and an interior space. The exterior surface is visible to the retail consumers, e.g., with product information printed thereon. The interior space may be a fully or a partially enclosed space for fully or partially enclosing the primary package(s). For example, the secondary package may be a container that fully enclose two primary packages that contain, separately and respectively, the liquid laundry detergent product and the liquid fabric enhancer product of the present invention. For another example, the secondary package may simply be a shrink wrap or a plastic bracket that holds the two or more primary packages together, e.g., in such proximity that the distance therebetween is no more than about 10 cm, preferably no more than about 5 cm, and more preferably no more than about 1 cm.

As used herein, the term "solvent" or "solvents" refers to organic solvent(s) only and does not include water.

As used herein, all concentrations and ratios are on a weight basis unless otherwise specified. All temperatures herein are in degrees Celsius (° C.) unless otherwise indicated. All conditions herein are at 20° C. and under the atmospheric pressure, unless otherwise specifically stated. All polymer molecular weights are determined by weight average number molecular weight unless otherwise specifically noted.

Liquid Laundry Detergent

The liquid laundry detergent composition of the present invention may contain one or more surfactants in an amount ranging from about 1% to about 99%, preferably from about 5% to about 95%, more preferably from about 10% to about 90%, and most preferably from about 15% to about 80%, by total weight of such detergent composition. The one or more surfactants may include any surfactant(s) selected from the group consisting of anionic surfactants, nonionic surfactants, cationic surfactants, zwitterionic surfactants, amphoteric surfactants, and combinations thereof.

Specifically, the liquid laundry detergent composition of the present invention includes an anionic surfactant in combination with a nonionic surfactant at specific amounts and weight ratios, as described hereinafter. Such specific anionic/nonionic surfactant amounts and weight ratios function to improve or maximize the overall cleaning benefit of the liquid laundry detergent composition, while reducing or minimizing the risk of gelling upon contact with the liquid fabric enhancer composition. Without the anionic surfactant or with too little anionic surfactant, the liquid laundry detergent composition may render a less than desirable cleaning benefit. On the other hand, without the nonionic surfactant or with too little nonionic surfactant, undesirable gelling may occur or become more severe.

The liquid laundry detergent composition contains from about 10 wt % to about 50 wt %, preferably from about 15 wt % to about 40 wt %, and more preferably from about 20 wt % to about 35 wt %, of an anionic surfactant. Useful anionic surfactants can themselves be of several different types. For example, water-soluble salts of the higher fatty acids, i.e., "soaps", are useful anionic surfactants in the compositions herein. This includes alkali metal soaps such as the sodium, potassium, ammonium, and alkyl ammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap. Additional non-soap anionic surfactants which are suitable for use herein include the water-soluble salts, preferably the alkali metal, and ammonium salts, of organic sulfuric reaction products having in their molecular structure an alkyl group (included in the term "alkyl" is the alkyl portion of acyl groups) containing from about 10 to about 20 carbon atoms and a sulfonic acid or sulfuric acid ester group. Examples of this group of synthetic anionic surfactants include, but are not limited to: a) the sodium, potassium and ammonium alkyl sulfates with either linear or branched carbon chains, especially those obtained by sulfating the higher alcohols ($C_{10}$-$C_{20}$ carbon atoms), such as those produced by reducing the glycerides of tallow or coconut oil; b) the sodium, potassium and ammonium alkylethoxy sulfates with either linear or branched carbon chains, particularly those in which the alkyl group contains from about 10 to about 20, preferably from about 12 to about 18 carbon atoms, and wherein the ethoxylated chain has, in average, a degree of ethoxylation ranging from about 0.1 to about 5, preferably from about 0.3 to about 4, and more preferably from about 0.5 to about 3; c) the sodium and potassium alkyl benzene sulfonates in which the alkyl group contains from about 10 to about 20 carbon atoms in either a linear or a branched carbon chain configuration, preferably a linear carbon chain configuration; d) the sodium, potassium and ammonium alkyl sulphonates in which the alkyl group contains from about 10 to about 20 carbon atoms in either a linear or a branched configuration; e) the sodium, potassium and ammonium alkyl phosphates or phosphonates in which the alkyl group contains from about 10 to about 20 carbon atoms in either a linear or a branched configuration; and f) the sodium, potassium and ammonium alkyl carboxylates in which the alkyl group contains from about 10 to about 20 carbon atoms in either a linear or a branched configuration, and combinations thereof. Especially preferred for the practice of the present invention are surfactant systems containing $C_{10}$-$C_{20}$ linear alkyl benzene sulphonates (LAS), $C_{10}$-$C_{20}$ linear or branched alkylethoxy sulfates (AES) having an average degree of ethoxylation ranging from about 0.1 to about 5 (preferably from about 0.3 to about 4 and more preferably from about 0.5 to about 3.

Preferred for the practice of the present invention are liquid laundry detergent compositions that contain one or more LAS surfactants and/or one or more AES surfactants, as described hereinabove. The LAS can be present in an amount ranging from 0% to about 50%, preferably from about 1% to about 45%, more preferably from about 5% to about 40%, and most preferably from about 10% to about 35%, by total weight of said liquid laundry detergent composition. The AES can also be present in an amount ranging from about 0% to about 50%, preferably from about 1% to about 45%, more preferably from about 5% to about 40%, and most preferably from about 10% to about 35%, by total weight of said liquid laundry detergent composition. The weight ratio of AES to LAS, if both are present, may range from about 1:10 to about 10:1, preferably from about 1:8 to about 3:1, and more preferably from about 1:5 to about 2:1. Such a AES-to-LAS weight ratio helps to improve the cleaning performance of the liquid laundry detergent compositions across various washing conditions.

Further, the liquid laundry detergent composition contains from about 3 wt % to about 50 wt %, preferably from about 5 wt % to about 40 wt %, and more preferably from about 10 wt % to about 30 wt %, of a nonionic surfactant. Preferred nonionic surfactants are those of the formula $R^1(OC_2H_4)_nOH$, wherein IV is a $C_8$-$C_{18}$ alkyl group or alkyl phenyl group, and n is from about 1 to about 80. Particularly preferred are $C_8$-$C_{18}$ alkyl alkoxylated alcohols having an average degree of alkoxylation from 1 to 20. The weight ratio of nonionic surfactant(s) to anionic surfactant(s) in such liquid laundry detergent may range from 1:10 to 3:1, preferably from 1:5 to 2:1, and more preferably from 1:3 to 1:1. Such a nonionic-to-LAS weight ratio helps to reduce gelling between the liquid laundry detergent composition and the liquid fabric enhancer composition, while ensuring satisfactory cleaning performance of the liquid laundry detergent composition.

Other surfactants useful herein include amphoteric surfactants and cationic surfactants. Such surfactants are well known for use in laundry detergents and are typically present at levels from about 0.2 wt % or 1 wt % to about 20 wt % or 30 wt % by total weight of the liquid laundry detergent composition.

The liquid laundry detergent composition of the present invention employs one or more organic solvents (hereinafter referred to as "solvents") as carriers, and it is therefore characterized by a relatively low water content, i.e., no more than about 15 wt %, and preferably no more than 10 wt %, for achieving the desired anti-gelling benefit. More preferably, the liquid laundry detergent composition contains little or no (i.e., no more than 5 wt %, preferably no more than 3 wt %, and more preferably no more than 1 wt %) water. In the most preferred embodiments of the present invention, water is completely absent, and the composition is anhydrous.

Suitable solvents of the present invention are characterized by a flash point of no less than about 50° C., preferably no less than about 80° C., and more preferably no less than about 90° C. It is preferred that the liquid laundry detergent composition of the present invention contains little or no (i.e., no more than 5 wt %, preferably no more than 3 wt %, and more preferably no more than 1 wt %) solvents having flash points lower than about 35° C., such as methanol, ethanol or isopropyl alcohol (IPA).

Such solvents for practice of the present invention may include: (1) $C_5$-$C_{20}$ monohydric alcohols, such as pentanol, hexanol, heptanol, octanol, nonanol, decanol, undecanol, dodecanol, and the like; (2) $C_2$-$C_{24}$ polyols, such as sugar alcohols (e.g., glycerol, mannitol, sorbitol, and the like) and diols (e.g., ethylene glycol, propylene glycol, and the like); and (3) combinations thereof. Particularly preferred solvents for practice of the present invention are diols, e.g., ethylene glycol, diethylene glycol, propylene glycol, dipropylene glycol, butylene glycol, pentanediol, and the like. The most preferably solvent for the practice of the present invention is propylene glycol. The solvent(s) may be present in the liquid laundry detergent composition of the present invention at levels in the range of from about 10% to about 95%, preferably from 15% to about 85%, more preferably from about 25% to about 75%, by total weight of the liquid laundry detergent composition.

The liquid laundry detergent composition of the present invention comprises one or more rheology modifiers (also referred to as a "structurants" in certain situations), which function to adjust the viscosity of the composition and impart a shear-thinning property thereto. The rheology modifier(s) as used herein can be any known ingredient that is capable of adjusting rheology to a liquid composition. Preferably the rheology modifier(s) is selected from the group consisting of hydroxy-containing crystalline material, polyacrylate, polysaccharide, polycarboxylate, amine oxide, alkali metal salt, alkaline earth metal salt, ammonium salt, alkanolammonium salt, $C_{12}$-$C_{20}$ fatty alcohol, di-benzylidene polyol acetal derivative (DBPA), di-amido gallant, a cationic polymer comprising a first structural unit derived from methacrylamide and a second structural unit derived from diallyl dimethyl ammonium chloride, and a combination thereof. Preferably, the rheology modifier(s) is a hydroxy-containing crystalline material generally characterized as crystalline, hydroxyl-containing fatty acids, fatty esters and fatty waxes, such as castor oil and castor oil derivatives. More preferably the rheology modifier is a hydrogenated castor oil (HCO). The rheology modifier can be present at any suitable level in the liquid laundry detergent composition. Preferably, the rheology modifier is present from 0.05% to 5%, preferably from 0.08% to 3%, more preferably from 0.1% to 1%, by total weight of the liquid laundry detergent composition.

The liquid laundry detergent composition of the present invention may further comprise, in addition to the ingredients described hereinabove, from about 0.1% to about 10%, preferably from about 0.5% to about 8%, and more preferably from about 1% to about 5% of one or more acids, such as citric acid, boric acid, and mixture thereof, by total weight of the liquid laundry detergent composition. Preferably, the liquid laundry detergent composition contains from about 1 wt % to about 3 wt % of citric acid and/or from about 1 wt % to about 3 wt % of boric acid. In addition, fatty acids, particularly $C_{12}$-$C_{18}$ fatty acids, or salts thereof can be included in the liquid laundry detergent composition of the present invention. The total amount of such fatty acids or salts may range from about 0.1 wt % to about 5 wt %, preferably from about 0.5 wt % to about 4 wt %, and more preferably from about 0.7 wt % to about 3 wt %.

The liquid laundry detergent compositions of the invention may also contain one or more adjunct ingredients commonly used for formulating liquid laundry detergent compositions, such as builders, fillers, carriers, structurants or thickeners, clay soil removal/anti-redeposition agents, polymeric soil release agents, polymeric dispersing agents, polymeric grease cleaning agents, enzymes, enzyme stabilizing systems, amines, bleaching compounds, bleaching agents, bleach activators, bleach catalysts, brighteners, dyes, hueing agents, dye transfer inhibiting agents, chelating agents, softeners or conditioners (such as cationic polymers or silicones), perfumes (including perfume encapsulates), hygiene and malodor treatment agents, and the like. Preferably, the liquid laundry detergent composition of the present invention is substantially free of any fabric softening agent as described hereinafter for the liquid fabric enhancer composition.

The liquid laundry detergent composition of the present invention is preferably characterized by a viscosity ranging from about 10 to 2000 mPa·s, preferably from 100 to about 1800 mPa·s, when measured at 20° C. at a shear rate of 20 $sec^{-1}$. The viscosity can be determined using a Brookfield viscometer, No. 2 spindle, at 60 RPM/s, measured at 25° C.

Highly preferred compositions afforded by the present invention are clear, isotropic liquids.

Liquid Fabric Enhancer

The liquid fabric enhancer composition of the present invention comprises a fabric softening agent in an amount ranging from about 2 wt % to about 90 wt %, preferably from about 5 wt % to about 50 wt %, and more preferably from about 10 wt % to about 30 wt %, by total weight of said liquid fabric enhancer composition.

Preferably, the fabric softening agent is a cationic compound, such as quaternary ammonium compounds, a cationic silicone, cationic starch, smectite clay, and combinations or derivatives thereof.

More preferably, it is a diester quaternary ammonium compound of formula (I):

$$\{R_{4-m}—N+-[(CH_2)_n—Y—R^5]_m\}A- \quad (I)$$

wherein each R is independently selected from the group consisting of hydrogen, a short chain $C_1$-$C_6$, poly($C_2$-$C_3$ alkoxy), benzyl, and mixtures thereof; m is 2 or 3; each n is independently from 1 to 4; each Y is independently —O—(O)C— or —C(O)—O—; the sum of carbons in each $R^5$ is $C_{11}$-$C_{21}$, with each $R^5$ independently being a hydrocarbyl or substituted hydrocarbyl group; and A- is a softener-compatible anion.

Preferably, in formula (I), each R is independently selected from a $C_1$-$C_3$ alkyl; m is 2; each n is independently from 1 to 2; each is independently —O—(O)C— or —C(O)—O—; the sum of carbons in each $R^5$ is $C_{12}$-$C_{20}$, with each $R^5$ independently being a hydrocarbyl or substituted hydrocarbyl group; and A- is selected from chloride, bromide, methylsulfate, ethylsulfate, sulfate, or nitrate. More preferably, the fabric softening agent is a bis-(2-hydroxyethyl)-dimethylammonium chloride fatty acid ester, preferably having an average chain length of the fatty acid moieties of from 16 to 20 carbon atoms, preferably from 16 to 18 carbon atoms.

Alternatively, the fabric softening agent can be a cationic silicone, such as polydimethylsiloxane polymers comprising at least one quaternized nitrogen atom.

The liquid fabric enhancer composition herein may comprise a rheology modifier that renders desired viscosity to the composition. Also, the rheology modifier functions as a structurant to sustain certain solid ingredients in the composition. Suitable levels of the rheology modifier herein are in the range of from about 0.001 wt % to about 10 wt %, alternatively from about 0.01 wt % to about 1 wt %, alternatively from about 0.1 wt % to about 0.5 wt %, alternatively from about 0.2 wt % to about 0.4 wt %, alternatively combinations thereof, by total weight of the liquid fabric enhancer composition. In one embodiment, the rheology modifier suitable for use herein can be selected from thickening stabilizers. These include gums and other similar polysaccharides, for example gellan gum, carrageenan gum, xanthan gum, Diutan gum (available from CP Kelco), and other known types of thickeners and rheological additives such as Rheovis® CDP (available from BASF), Alcogum® L-520 (available from Alco Chemical), and Sepigel 305 (available from SEPPIC). In another embodiment, cationic acrylic-based polymers are utilized as the rheology modifier herein. One example of such rheology modifier is poly(acrylic acid). Another example is cationic acrylic based polymer, sold under the name Rheovis® CDE by BASF.

In addition to the fabric softening agent(s), the liquid fabric enhancer composition of the present invention may also comprise other materials, non-limiting examples of which include surfactants, solvents, salts (e.g., $CaCl_2$)), acids (e.g., HCl and formic acid), preservatives, and water. Preferably, the liquid fabric enhancer composition of the present invention is substantially free of the anionic and nonionic surfactants described hereinabove for the liquid laundry detergent composition, and more preferably it is substantially free of any surfactants.

Preferably, but not necessary, the liquid fabric enhancer composition of the present invention also contains one or more organic solvents (hereinafter "solvents") as described hereinabove for the liquid laundry detergent composition, e.g., solvents characterized by a flash point of no less than about 50° C., preferably no less than about 80° C., and more preferably no less than about 90° C. It is particularly preferred that the liquid fabric enhancer composition of the present invention contains little or no (i.e., no more than about 5 wt %, preferably no more than about 3 wt %, and more preferably no more than about 1 wt %) solvents having flash points lower than about 35° C., such as methanol, ethanol or isopropyl alcohol (IPA).

Total Surfactant Content and Total Solvent Content

As mentioned hereinabove, it is important that the liquid laundry detergent and the liquid fabric enhancer, when combined at an about 1:1 weight ratio, are characterized by: (i) a total surfactant content of greater than about 25 wt %, preferably greater than about 30 wt %, more preferably greater than about 35 wt %, and most preferably greater than about 50 wt %; and (ii) a total organic solvent content of greater than about 7.5 wt %, preferably greater than about 10 wt %, more preferably greater than about 15 wt %, and most preferably greater than about 20 wt %, by total weight of the liquid laundry detergent and the liquid fabric enhancer combined. Such total surfactant content and such total organic solvent content provides a desirable overall cleaning benefit, while reducing or minimizing undesirable gelling. Suitable surfactants and solvents that contribute to such total contents are as described hereinabove.

Preferably, the liquid laundry detergent and the liquid fabric enhancer, when combined at an about 1:1 weight ratio, are characterized by: (a) a total anionic surfactant content of greater than about 10 wt %, preferably greater than about 12 wt %, and more preferably greater than about 15 wt %; and (b) a total diol content of greater than about 5 wt %, preferably greater than about 7.5 wt %, and more preferably greater than about 10 wt %, by total weight of the liquid laundry detergent and the liquid fabric enhancer combined.

Kit

The liquid laundry detergent and the liquid fabric enhancer as described hereinabove can be commercialized together as a pack or a bundle in a fabric cleaning kit. Specifically, such liquid laundry detergent and the liquid fabric enhancer can be placed in separate primary packages, which can in turn be placed in a unitary secondary package for commercialization purposes.

For example, the liquid laundry detergent composition can be placed in a first primary package, which is in direct contact with the liquid laundry detergent product; at the same time, the liquid fabric enhancer composition can be placed in a second, separate primary package, which is in direct contact with the liquid fabric enhancer composition. Such first and second primary packages can be pouches (especially standup pouches), bottles, jars, cans, cartons, etc. Such first and second primary packages are preferably water-proof or water-resistant, so as to minimize any potential leakage of the liquid products. Both the first and second primary packages may include a coordinate element, such as a common brand name, logo, graphic, trade dress, label or usage instruction, or a combination thereof.

Such first and second primary packages can then be placed inside a unitary secondary package, i.e., they are commercialized together as one unit for retail purposes. The secondary package may further function to protect or beautify the primary packages. It may include an exterior surface and an interior space. The exterior surface is visible to the retail consumers, preferably with product information (e.g., brand name, logo, product names, graphics, usage instructions, etc.) printed thereon. The interior space may be a fully or a partially enclosed space, which may fully or partially enclose the primary package(s). For example, the secondary package may be a container that fully enclose the first and second primary packages. For another example, the secondary package may include simply a shrink wrap or a plastic bracket that bundles the first and second primary packages together, e.g., in such proximity that the distance therebetween is no more than about 10 cm, preferably no more than about 5 cm, and more preferably no more than about 1 cm.

The above-described secondary package may also be integrated with the primary packages, e.g., to form a container with multiple compartments, while at least one compartment (i.e., the first primary package) accommodates the liquid laundry detergent, and another, separate compartment (i.e., the second primary package) accommodates the liquid fabric enhancer.

The fabric cleaning kit as described hereinabove may contain a set of usage instructions, which are attached to the kit in any location and in any form (e.g., visual, audio, tactile such as braile, etc.), as long as it is perceivable to a consumer purchasing such kit. For example, the set of user instructions can be provided on the exterior surface or in the interior space of the secondary package. Alternatively, such instructions can be provided on the first and/or second primary packages. Preferably, the exterior surface of the secondary package contains instruction for using the liquid laundry detergent and liquid fabric enhancer in combination, especially inside an automatic laundry washing machine to prevent or reducing gelling therebetween.

Combined Use in Automatic Laundry Washing Machine and Cleaning System Comprising the Same The liquid laundry detergent and the liquid fabric enhancer as described hereinabove can be used in combination with one or more cleaning device to treat fabrics. Such cleaning device may be manual laundering devices, but preferably it is an automatic or semi-automatic laundry washing machine.

Preferably, the automatic laundry washing machine is configured for executing a cleaning cycle, i.e., with a washing step followed by at least one rinse step. The automatic laundry washing machine may include a cleaning chamber for receiving an article for cleaning, and one or more dispensers (i.e., dosing containers) for storing and dispensing specific laundry or fabric treatment products. Each dispenser may connect with at least one valve, at least one dispensing pump, and/or at least one flow meter, to control and monitor dosing of the respective laundry or fabric treatment products contained therein.

Preferably, the automatic laundry washing machine contains a detergent dispenser that is fluidly connected with the cleaning chamber. A liquid laundry detergent as described hereinabove is stored in such detergent dispenser, which is configured for dispensing the liquid laundry detergent into the cleaning chamber as a part of the cleaning cycle, e.g., during the washing step. Further, the automatic laundry washing machine may include a liquid fabric enhancer dispenser, which is fluidly connected with the cleaning chamber. A liquid fabric enhancer as described hereinabove is stored in such liquid fabric enhancer dispenser, which is configured for dispensing the liquid fabric enhancer into the cleaning chamber as a part of the cleaning cycle, e.g., during the rinse step.

The automatic laundry washing machine may further contain a water supply fluidly, which is connected with at least one of the cleaning chamber, the detergent dispenser and the liquid fabric enhancer dispenser for supplying water thereto to generate a wash liquid for treating fabrics. The washing liquid may contain water, the liquid laundry detergent, the liquid fabric enhancer, and mixtures thereof. It may contain one or more other fabric treatment additives.

In a specific embodiment of the present invention, the liquid fabric enhancer dispenser, the detergent dispenser, and the water supply of the automatic laundry washing machine are arranged so that at least an undiluted portion of the liquid laundry detergent and at least an undiluted portion of the liquid fabric enhancer contact each other, i.e., before they are diluted by water to form the washing liquid. For example, the water supply may supply water directly into the cleaning chamber from one side of the washing machine, while the liquid fabric enhancer dispenser and the detergent dispenser may locate at another side of the washing machine, with dispensing outlets that are placed sufficiently close to each other, or even dispensing outlets that open into a common liquid pipeline. Residue of the already dispensed laundry detergent may accumulate near such dispensing outlets and/or inside such common liquid pipeline, and thereby coming into direct contact with the subsequently dispensed liquid fabric enhancer in absence of water.

To prevent or reduce gelling between the residue laundry detergent and the residue fabric enhancer, the present invention proposes the combined use of the above-described laundry detergent and the above-described fabric enhancer, which have compositional characteristics that can help to reduce or prevent gelling inside such automatic laundry washing machine. A user can easily purchase a fabric cleaning kit as described hereinabove, which contains both the laundry detergent and the fabric enhancer of the present invention, and introduce them into respective dispensers of such automatic laundry washing machine.

Although it is possible to design new automatic laundry washing machines with more spaced-apart dispensing outlets that directly open into the washing drum separately (i.e., without the common liquid pipeline), or to reconstruct the liquid conduits or pipelines of the current washing machines with such spaced-apart dispensing outlets, it is neither practical nor likely for consumers to do so.

Method of Using

The present invention includes methods for treating soiled material using the liquid laundry detergent and the liquid fabric enhancer of the present invention. As will be appreciated by one skilled in the art, the liquid laundry detergent and the liquid fabric enhancer of the present invention are suited for use in laundry pretreatment applications as well as laundry cleaning applications.

Preferably, such a method is a method of using the liquid laundry detergent and the liquid fabric enhancer of the present invention in combination to clean and treat soiled material, which includes, but are not limited to, the steps of providing the liquid laundry detergent and the liquid fabric enhancer as described hereinabove (either in neat form or diluted in a wash liquor), contacting such liquid laundry detergent with at least a portion of a soiled material during a pretreat and/or washing cycle, manually or semi-manually clean the soiled material, followed by rinsing the soiled material during one or more rinse cycles, and either during or near the end of the rinse cycle(s) contacting the liquid fabric enhancer with at least a portion of the soiled material.

Alternatively, the liquid laundry detergent and the liquid fabric enhancer of the present invention are suitable for machine laundry methods, which may comprise treating soiled laundry with an aqueous wash solution in a washing machine having dissolved or dispensed therein an effective amount of the liquid laundry detergent and/or the liquid fabric enhancer in accord with the invention. Specifically, the present invention proposes a method of reducing gelling between a liquid laundry detergent and a liquid fabric enhancer inside an automatic laundry washing machine, by using the liquid laundry detergent and the liquid fabric enhancer of the present invention inside an automatic laundry washing machine to treat fabrics.

An "effective amount" of the liquid laundry detergent and/or the liquid fabric enhancer means from about 1 g to about 300 g of the respective product dissolved or dispersed in a wash solution of volume from about 5 to about 65 . The water temperatures may range from about 5° C. to about 100° C. The water to soiled material (e.g., fabric) ratio may be from about 1:1 to about 30:1. The detergent compositions may be employed at concentrations of from about 300 ppm to about 40,000 ppm, preferably from about 350 ppm to about 10,000 ppm, and more preferably from about 400 ppm to about 5000 ppm, in solution. In the context of a liquid laundry detergent composition, usage levels may also vary depending not only on the type and severity of the soils and stains, but also on the wash water temperature, the volume of wash water, as well as the type of washing machine (e.g., top-loading, front-loading, top-loading, vertical-axis Japanese-type automatic laundry washing machine).

The liquid laundry detergent and liquid fabric enhancer compositions herein may be used for treating fabrics at reduced wash temperatures. These methods of treating fabrics comprise the steps of delivering a liquid laundry detergent and/or a liquid fabric enhancer composition to water to form a wash liquor and adding a laundering fabric to said wash liquor, wherein the wash liquor has a temperature of from about 0° C. to about 20° C., or from about 0° C. to about 15° C., or from about 0° C. to about 9° C. The fabric may be contacted with the water prior to, or after, or simultaneous with, contacting the liquid laundry detergent and/or the liquid fabric enhancer composition with water.

EXAMPLE

Three (3) different liquid laundry detergent compositions ("HDL") with the following ingredients are provided:

TABLE I

| Ingredients (Wt %) | HDL 1 | HDL 2 | HDL 3 |
|---|---|---|---|
| Propylene glycol | 5.5 | 15 | 23.5 |
| Monoethanolamine (MEA) | 9.7 | 8.8 | 7.9 |
| Glycerol | 7.1 | 6.4 | 5.8 |
| $C_{12}$-$C_{14}$ alkyl ethoxylated alcohols (EO7) | 18.3 | 16.5 | 14.9 |
| Linear alkylbenzene sulfonic acid (HLAS) | 26.2 | 23.6 | 21.2 |
| Polyethyleneimine | 7.7 | 6.9 | 6.2 |
| 1-Hydroxy ethylidene-1,1-diphosphonic acid (HEDP) | 2 | 2.7 | 2.5 |
| MEA-alkyl ethoxylated sulfate with fatty acid | 12.5 | 11.2 | 10 |
| Water | 11 | 8.9 | 8 |
| Total surfactant content | 57 | 51.3 | 46.1 |
| Total anionic surfactant content | 38.7 | 34.8 | 31.2 |
| Total organic solvent content | 12.6 | 21.4 | 29.3 |

One (1) liquid fabric enhancer composition ("FE") with the following ingredients is provided:

TABLE II

| Ingredients (Wt %) | FE |
|---|---|
| Di-Tallowoylethanolester dimethylammonium chloride | 9.75 |
| Isopropyl alcohol | 0.75 |
| Perfume/dye | 1 |
| Water | 88.5 |

When each of the three HDL compositions is combined with the FE composition at a 1:1 weight ratio, the total surfactant content and the total organic solvent content of the respective combination are as follows:

TABLE III

| Ingredients (Wt %) | HDL 1 + FE | HDL 2 + FE | HDL 3 + FE |
|---|---|---|---|
| Total surfactant content | 33.38 | 30.53 | 27.93 |
| Total anionic surfactant content | 19.35 | 17.40 | 15.60 |
| Total organic solvent content | 6.68 | 11.08 | 15.03 |
| Total propylene glycol content | 2.75 | 7.5 | 11.75 |

While the combination of HDL 2 and FE and the combination of HDL 3 and FE are characterized by total surfactant contents and total organic solvent contents that fall within the scope of the present invention, the combination of HDL 1 and FE is characterized by a total organic solvent content that is too low, i.e., lower than 7.5 wt % by total weight of HDL 1 and FE combined. Therefore, the combination of HDL 1 and FE does not fall within the scope of the present invention.

Viscosity of each of the 3 HDL compositions, the FE composition, and their respective combinations as described hereinabove is measured at 20° C. at a shear rate of about 1 $sec^{-1}$, and following are the results:

TABLE IV

| Composition | Viscosity (mPa·s) | Viscosity Increase* | Gelling? |
|---|---|---|---|
| FE | 358.6 | 149.5% | Yes |
| HDL 1 | 1228.5 | | |
| HDL 1 + FE | 3064.5 | | |
| FE | 358.6 | 17.8% | No |
| HDL 2 | 747.4 | | |
| HDL 2 + FE | 880.5 | | |
| FE | 358.6 | −27.6% | No |
| HDL 3 | 556.7 | | |
| HDL 3 + FE | 403.1 | | |

*Calculated as $\frac{\text{Viscosity of Mixture} - \text{Viscosity of the More Viscous Liquid}}{\text{Viscosity of the More Viscous Liquid}} \times 100\%$ It is evident from the viscosity results hereinabove that while significant gelling occurred when mixing HDL 1 with FE, little or no gelling is observed when HDL 2 or HDL 3 is mixed with FE, indicating that the HDL and FE combinations within the scope of the present invention are effective in reducing or eliminating gelling.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of reducing gelling between a liquid laundry detergent and a liquid fabric enhancer inside an automatic laundry washing machine, comprising the steps of:

a. providing a liquid laundry detergent that comprises: (i) a water content of no more than 15 wt %; (ii) a nonionic surfactant content ranging from 3 wt % to 50 wt %; and (iii) an anionic surfactant content ranging from 10 wt % to 50 wt %, by total weight of said liquid laundry detergent;

b. providing a liquid fabric enhancer that comprises from 2 wt % to 90 wt % of a fabric softening agent, by total weight of said liquid fabric enhancer, wherein said liquid laundry detergent and said liquid fabric enhancer, when combined at a 1:1 weight ratio, form a mixture, said mixture comprising:

(i) a total surfactant content of greater than 25 wt %; and (ii) a total organic solvent content of greater than 7.5 wt %, by total weight of said mixture;

c. providing an automatic laundry washing machine that is configured so that at least an undiluted portion of the liquid laundry detergent comes into contact with at least an undiluted portion of the liquid fabric enhancer in said automatic laundry washing machine; and d. using said liquid laundry detergent and said liquid fabric enhancer inside said automatic laundry washing machine to treat fabrics.

2. The method of claim 1, wherein the liquid laundry detergent and/or the liquid fabric enhancer comprise one or more organic solvents having a flash point of no less than 80° C.

3. The method of claim 2, wherein said one or more organic solvents are selected from the group consisting of $C_5$-$C_{20}$ monohydric alcohols, $C_2$-$C_{24}$ polyols, and combinations thereof.

4. The method of claim 2, wherein said one or more organic solvents comprises one or more diols selected from the group consisting of ethylene glycol, diethylene glycol, propylene glycol, dipropylene glycol, butylene glycol, pentanediol, and combinations thereof.

5. The method of claim 1, wherein said liquid laundry detergent is further characterized by a viscosity ranging from 100 mPa·s to 1800 mPa·s when measured at 20° C. at a shear rate of 20 $s^{-1}$.

6. The method according to claim 1, wherein the weight ratio of nonionic surfactant(s) to anionic surfactant(s) in said liquid laundry detergent ranges from 1:10 to 3:1.

7. The method according to claim 6, wherein the weight ratio of nonionic surfactant(s) to anionic surfactant(s) in said liquid laundry detergent ranges from 1:5 to 2:1.

8. The method according to claim 1, wherein said liquid laundry detergent comprises one or more rheology modifier that imparts a shear-thinning property thereto.

9. The method according to claim 8, wherein said one or more rheology modifiers comprise a hydrogenated castor oil.

10. A laundry cleaning system, comprising an automatic laundry washing machine that comprises a cleaning chamber, a water supply, a detergent dispenser, a fabric enhancer dispenser, wherein said detergent dispenser contains a liquid laundry detergent, wherein said fabric enhancer dispenser contains a liquid fabric enhancer, and wherein said detergent dispenser and said fabric enhancer dispenser are arranged so that at least an undiluted portion of the liquid laundry detergent comes into contact with at least an undiluted portion of the liquid fabric enhancer in said automatic laundry washing machine;

wherein said liquid laundry detergent comprises : (i) a water content of no more than 15 wt %; (ii) a nonionic surfactant content ranging from 3 wt % to 50 wt %; and (iii) an anionic surfactant content ranging from 10 wt % to 50 wt %, by total weight of said liquid laundry detergent;

wherein said liquid fabric enhancer comprises from 2 wt % to 90 wt % of a fabric softening agent, by total weight of said liquid fabric enhancer; and wherein said liquid laundry detergent and said liquid fabric enhancer, when combined at a 1:1 weight ratio, form a mixture, said mixture comprising:

(i) a total surfactant content of greater than 25 wt %; and (ii) a total organic solvent content of greater than 7.5 wt %, by total weight of said mixture.

11. The laundry cleaning system of claim 10, wherein the liquid laundry detergent and/or the liquid fabric enhancer comprise one or more organic solvents having a flash point of no less than 80° C.

12. The laundry cleaning system according to claim 10, wherein said liquid laundry detergent is further characterized by a viscosity ranging from 100 mPa·s to 1800 mPa·s when measured at 20° C. at a shear rate of 20 $s^{-1}$.

13. The laundry cleaning system according to claim 10, wherein the weight ratio of nonionic surfactant(s) to anionic surfactant(s) in said liquid laundry detergent ranges from 1:10 to 3:1.

14. The laundry cleaning system according to claim 10, wherein said liquid laundry detergent comprises one or more rheology modifier that imparts a shear-thinning property thereto.

15. A fabric cleaning kit comprising:

a. a first primary package containing a liquid laundry detergent;

b. a second, separate primary package containing a liquid fabric enhancer; and c. a secondary package containing said first primary package and said second primary package;

wherein said liquid laundry detergent comprises: (i) a water content of no more than 15 wt %; (ii) a nonionic surfactant content ranging from 3 wt % to 50 wt %; and (iii) an anionic surfactant content ranging from 10 wt % to 50 wt %, by total weight of said liquid laundry detergent;

wherein said liquid fabric enhancer comprises from 2 wt % to 90 wt % of a fabric softening agent, by total weight of said liquid fabric enhancer; and wherein said liquid laundry detergent and said liquid fabric enhancer, when combined at a 1:1 weight ratio, form a mixture, said mixture comprising:

(i) a total surfactant content of greater than 25 wt %; and (ii) a total organic solvent content of greater than 7.5 wt %, by total weight of said mixture.

16. The fabric cleaning kit of claim 15, wherein said secondary package has an exterior surface having instructions for using the liquid laundry detergent and the liquid fabric enhancer in combination.

17. The fabric cleaning kit according claim 15, wherein the liquid laundry detergent and/or the liquid fabric enhancer comprise one or more organic solvents having a flash point of no less than 80° C.

18. The fabric cleaning kit according claim 15, wherein the liquid laundry detergent and/or the liquid fabric enhancer comprise one or more organic solvents selected from the group consisting of ethylene glycol, diethylene glycol, propylene glycol, dipropylene glycol, butylene glycol, pentanediol, and combinations thereof.

19. The fabric cleaning kit according to claim 15, wherein said liquid laundry detergent is further characterized by a viscosity ranging from 100 mPa·s to 1800 mPa·s when measured at 20° C. at a shear rate of 20 $s^{-1}$.

20. The fabric cleaning kit according to claim 15, wherein the weight ratio of nonionic surfactant(s) to anionic surfactant(s) in said liquid laundry detergent ranges from 1:10 to 3:1.

* * * * *